US006461044B1

(12) United States Patent
Anderson

(10) Patent No.: US 6,461,044 B1
(45) Date of Patent: Oct. 8, 2002

(54) RECLOSABLE BAG FORMED ON FORM, FILL AND SEAL MACHINE

(75) Inventor: Richard F. Anderson, Massillon, OH (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/592,426

(22) Filed: Jun. 12, 2000

(51) Int. Cl.[7] ..... B65D 33/20

(52) U.S. Cl. ..... 383/211; 383/66; 383/95; 383/204

(58) Field of Search ..... 383/210, 211, 383/95, 61, 66, 204, 210.1

(56) References Cited

U.S. PATENT DOCUMENTS

| | | | | | |
|---|---|---|---|---|---|
| 2,480,500 | A | * | 8/1949 | Moore | 383/95 |
| 2,978,769 | A | | 4/1961 | Harrah | 24/201 |
| 3,329,331 | A | | 7/1967 | Moran | |
| 3,595,468 | A | | 7/1971 | Repko | 229/66 |
| 3,613,874 | A | * | 10/1971 | Miller | 383/95 |
| 4,335,817 | A | * | 6/1982 | Bahr | 383/66 |
| 4,337,889 | A | | 7/1982 | Moertel | 229/62 |
| 4,528,224 | A | | 7/1985 | Ausnit | 428/36 |
| 4,617,683 | A | | 10/1986 | Christoff | 383/63 |
| 4,633,508 | A | | 12/1986 | Sanders | 393/95 |
| 4,655,862 | A | | 4/1987 | Christoff et al. | 156/66 |
| 4,709,399 | A | | 11/1987 | Sanders | 383/66 |
| 4,786,190 | A | | 11/1988 | Van Erden et al. | 383/61 |
| 4,874,257 | A | | 10/1989 | Inagaki | 383/63 |
| 4,894,975 | A | | 1/1990 | Ausnit | 53/412 |
| 4,905,298 | A | | 2/1990 | Walor | 383/95 |
| 4,909,017 | A | | 3/1990 | McMahon et al. | 53/410 |
| 4,913,293 | A | | 4/1990 | Sanders | 206/620 |
| 4,944,409 | A | | 7/1990 | Busche et al. | 206/632 |
| 5,007,744 | A | | 4/1991 | Scarberry et al. | |
| 5,172,854 | A | * | 12/1992 | Epstein et al. | 383/204 |
| 5,287,960 | A | | 2/1994 | Kalb et al. | |
| 5,346,301 | A | | 9/1994 | Scarberry et al. | 383/5 |
| 5,407,278 | A | * | 4/1995 | Beer | 383/210 |
| 5,461,845 | A | | 10/1995 | Yaeger | 53/451 |

(List continued on next page.)

FOREIGN PATENT DOCUMENTS

| | | |
|---|---|---|
| FR | 2 345 355 | 10/1977 |
| FR | 2681 581 A1 | 3/1993 |
| GB | 916266 | 1/1963 |
| GB | 2 193 484 A | 2/1988 |
| GB | 2 265 883 A | 10/1993 |
| JP | 5 221454 | 8/1993 |

*Primary Examiner*—Stephen P. Garbe
(74) *Attorney, Agent, or Firm*—Alston & Bird LLP

(57) ABSTRACT

A reclosable bag made on a form, fill and seal machine by a method which includes the steps of: applying an adhesive strip of material to a web of bag material to extend transversely relative to longitudinal edges of the web, the adhesive strip including a front surface releasably applied to the web via a pressure-sensitive adhesive and an exposed rear surface; folding the web about an axis extending parallel to the longitudinal edges thereof; and then sealing the web to form the bag, including permanently sealing a portion of the web to the exposed rear surface of the adhesive strip to form a reclosable end seal. Another method includes the steps of: forming an opening location in a web of bag material having a length extending generally between longitudinal edges of the web; applying an adhesive strip to the web over the opening location, the adhesive strip including a front surface releasably applied to the web via a pressure-sensitive adhesive and an exposed rear surface, the front surface extending to opposite lateral sides of the transversely extending opening location; folding the web about an axis extending parallel to the longitudinal edges; and sealing the web to form the reclosable bag, including permanently sealing a portion of the web to the exposed rear surface of the adhesive strip and a portion of the web to the front surface of the adhesive strip, but only to one lateral side of the opening location.

5 Claims, 8 Drawing Sheets

U.S. PATENT DOCUMENTS 5,480,230 A 1/1996 May
5,601,368 A * 2/1997 Bodolay et al. ..... 383/66
5,672,009 A * 9/1997 Malin ..... 383/204
5,749,658 A * 5/1998 Kettner ..... 383/204
5,806,984 A * 9/1998 Yeager ..... 383/204
5,836,697 A * 11/1998 Chiesa ..... 383/205
5,855,434 A 1/1999 Hagen ..... 383/89
5,855,435 A 1/1999 Chiesa
5,928,749 A 7/1999 Forman
6,019,512 A * 2/2000 Yeager ..... 383/203
6,106,153 A * 8/2000 Toshima ..... 383/204
6,174,397 B1 * 1/2001 Johnson ..... 383/66
6,190,043 B1 * 2/2001 Diplock ..... 383/66
6,244,746 B1 * 6/2001 Tokita et al. ..... 383/209
6,244,748 B1 * 6/2001 Kasai et al. ..... 383/203

* cited by examiner

RECLOSABLE BAG FORMED ON FORM, FILL AND SEAL MACHINE

FIELD OF THE PRESENT INVENTION

The present invention relates to reclosable bags manufactured on form, fill and seal machines and, more particularly, to a reclosable bag manufactured on a form, fill and seal machine which includes a strip of material having a front surface thereof releasably adhered to the interior of the bag and a rear surface thereof permanently adhered to the interior of the bag.

BACKGROUND OF THE PRESENT INVENTION

It is well-known to manufacture conventional flexible bags on a vertical form, fill and seal (VFF) machine, as well as on a horizontal form, fill and seal (HFF) machine. Thus, for example, in a VFF machine the bag is manufactured by shaping a web of bag material such as a plastic film into a tube, making a parallel side seal in the tube and then a transverse bottom end seal in the tube, filling the open-ended tube with product, and then making a transverse top end seal to enclose the product. A cut is then made at or above the top end seal to render the packaged product.

An opening location is typically provided parallel to the top and bottom transverse end seals in the bag material for opening of the bag. The opening location often comprises a line of perforations or a weakened line formed in the bag material where, by tearing or severing along the opening location, access to the product is gained. The opening location also can comprise a panel formed in the bag material removable by grasping a pull tab and tearing along a perforated outline of the panel.

It is often desirable to use only a portion of the packaged product and retain the rest of the product within the bag. To this end, Yeager U.S. Pat. No. 5,461,845 discloses a bag that is intended to be formed on a VFF machine which includes a fastener assembly having two interlocking profile strips each of which is independently attached to the inside surface of the bag material on opposite sides of an opening location. Yeager U.S. Pat. No. 5,806,984 discloses a similar reclosable bag having the same two interlocking profile strips forming the reclosable assembly; however, the '984 Patent further discloses that the two strips are peelably sealed together to form an airtight seal until such time as the bag is first opened. Thereafter, the interlocking profile strips are solely utilized to reclose the bag.

An actual method for making a reclosable bag on a VFF machine utilizing interlocking profile strips is disclosed in McMahon et al. U.S. Pat. No. 4,909,017, wherein the pair of interlocking profile strips are mated and then attached to the web of bag material. Specifically, one of the interlocking profile strips is permanently sealed to the web of bag material to extend transversely between the longitudinal side edges thereof with the other interlocking profile strip simply remaining interlocked with the first strip. The web is then filled and formed into bags on a VFF machine as shown in FIG. 1 of McMahon et al. Furthermore, when making the top end seal, the interlocking profile strip which is not yet sealed to the bag material is then permanently sealed to the bag material at a location on the back panel of the bag as shown in FIG. 5. A similar method for making a reclosable bag on a VFF machine utilizing interlocking profile strips is disclosed in Christoff et al. U.S. Pat. No. 4,655,862.

Another type of reclosable bag intended to be formed on a VFF machine is disclosed in FIGS. 18 and 19 of Sanders U.S. Pat. No. 4,709,399, wherein a single surface of a strip of material is adhered only to a single bag wall in covering relation to an opening formed in a panel of the bag wall. Furthermore, only a portion of the strip is releasably sealed to the single bag wall, with the remaining portion of the strip being permanently sealed to the single bag wall. A similar bag is disclosed in Sanders U.S. Pat. No. 4,913,293. Unlike the aforesaid reclosable bags, the bags of Sanders do not utilize interlocking profile strips but, instead, utilize only a single strip of material.

The present invention provides yet two additional, unique methods for making reclosable bags specifically on form, fill and seal machines including both VFF machines and HFF machines.

SUMMARY OF THE PRESENT INVENTION

Briefly described, the present invention includes the method of making a reclosable bag on a form, fill and seal machine including the steps of: applying a strip of material to a web of bag material to extend transversely relative to longitudinal edges of the web, the strip including a front surface releasably applied to the web via a pressure-sensitive adhesive and an exposed rear surface; folding the web about an axis extending parallel to the longitudinal edges thereof; and then, sealing the web to form the bag, including permanently sealing a portion of the web to the exposed rear surface of the strip to form a reclosable transverse end seal of the bag. The strip of material extends less than the width of the web and, preferably, either is slightly less than, equal to, or slightly more than one-half of the width of the web.

Features of this method include: sealing together overlapping portions of the web in a direction parallel to the longitudinal edges of the web to form a side seal of the bag, and sealing together overlapping portions of the web in a direction transverse to the longitudinal edges of the web to define a non-reclosable transverse end seal; filling the bag with product during the step of forming the bag; and folding the web about an axis collinear with a cylindrical feed tube of a VFF machine.

The present invention also includes the additional method of making a reclosable bag on a form, fill and seal machine including the steps of: forming an opening location in a web of bag material having a length extending generally transversely between longitudinal edges of the web; applying a strip of material to the web in covering relation to the opening location, the strip including a front surface releasably applied to the web via a pressure-sensitive adhesive and an exposed rear surface, the front surface extending to opposite lateral sides of the transversely extending opening location; folding the web about an axis extending parallel to the longitudinal edges; and sealing the web to form the reclosable bag, including permanently sealing a portion of the web to the exposed rear surface of the strip. The strip of material extends preferably slightly beyond opposed ends of the transversely extending opening location.

Features of this additional method include: permanently sealing a portion of the web to the front surface of the strip, but only to one side of the opening location; sealing together overlapping portions of the web in a direction parallel to the longitudinal edges and in a direction transverse to the longitudinal edges to respectively form a longitudinal side seal and two non-reclosable transverse end seals; forming a non-reclosable transverse end seal of the bag by permanently sealing the bag material to the rear surface of the strip of material, and to the front surface of the strip of material but only on one side of the opening location; and defining the opening location by a line of weakness formed in the web of bag material extending generally linearly between the longitudinal edges of the web, the line of weakness preferably comprising perforations.

Commensurate with the aforesaid methods of the present invention, the present invention also includes reclosable bags formed on a form, fill and seal machine. Thus, one bag of the present invention includes a sheet of bag material folded and sealed together at a side seal and two end seals to define the bag; and a strip of material disposed parallel and adjacent to an end seal and having a front surface releasably attached to the bag material via a pressure-sensitive adhesive and a rear surface permanently sealed to the bag material.

The other bag of the present invention includes a sheet of bag material folded and sealed together at a longitudinal side seal and two transverse end seals to define the bag; and a strip of material having a rear surface to which said bag material is sealed and a front surface disposed in covering relation to and on opposite sides of an opening location formed in the bag material, the front surface of the strip of material being releasably attached to the bag material at least on one side of the opening location only by way of a pressure-sensitive adhesive. In a feature of this bag, the front surface of the strip is also permanently sealed to the bag material on one side of said opening location.

In a feature of these two bags of the present invention, a transverse end seal and the seal between the bag material and the rear surface of the strip of material are continuous with each other.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
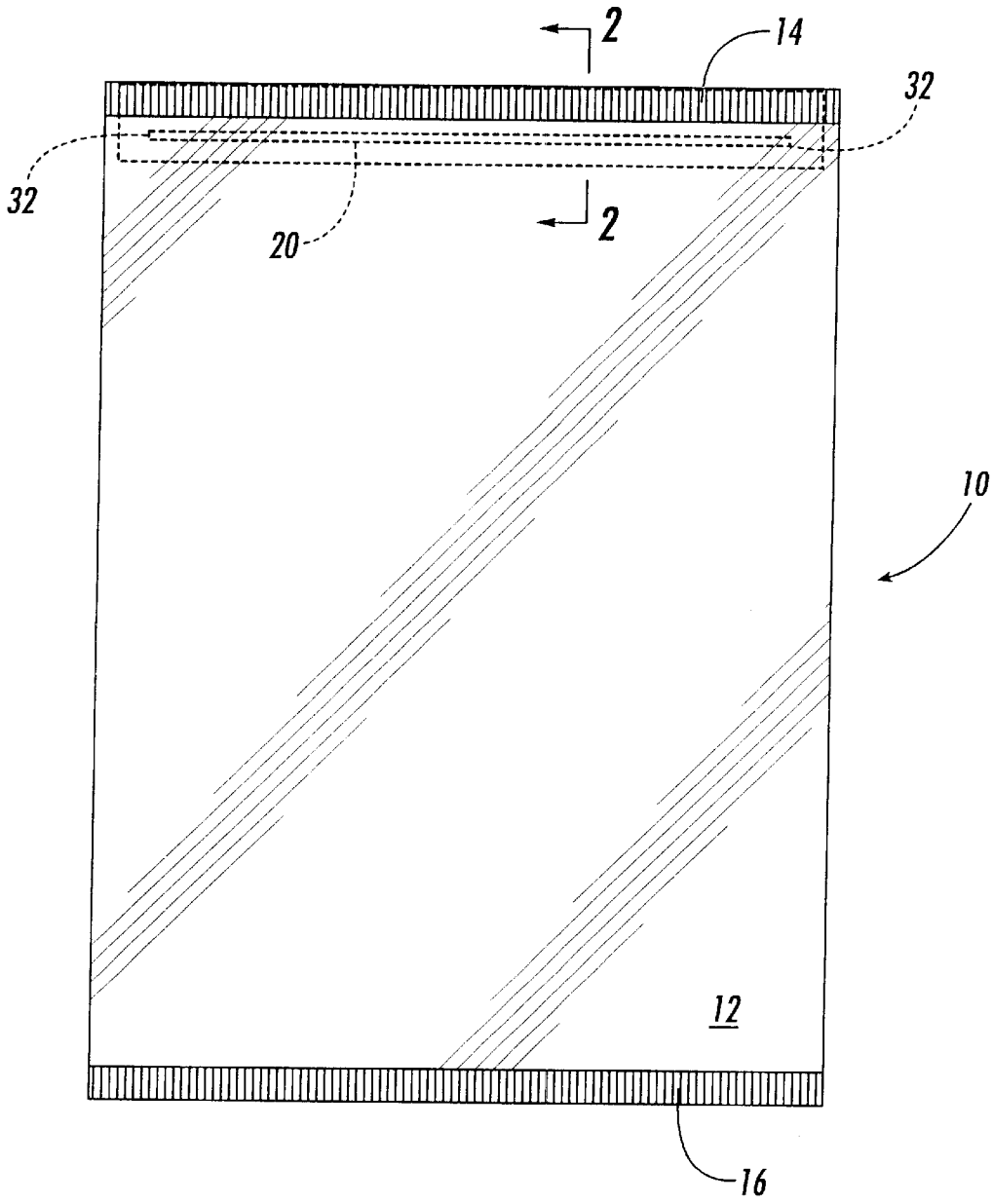
FIG. 1 is an elevational view of the front of a bag of the present invention.

A first reclosable bag 10 is shown in FIG. 1 and includes a bag material 12 folded and sealed to enclose a product (not shown) therein. Specifically, the-bag 10 includes a transverse top end seal 14 and a transverse bottom end seal 16 as well as a longitudinal side seal 18 (shown in FIG. 5). A transversely extending opening location is formed by a panel 20 defined by perforations in the bag material 12, the panel 20 being easily removed for access to the interior of the bag 10.

Figure 2:
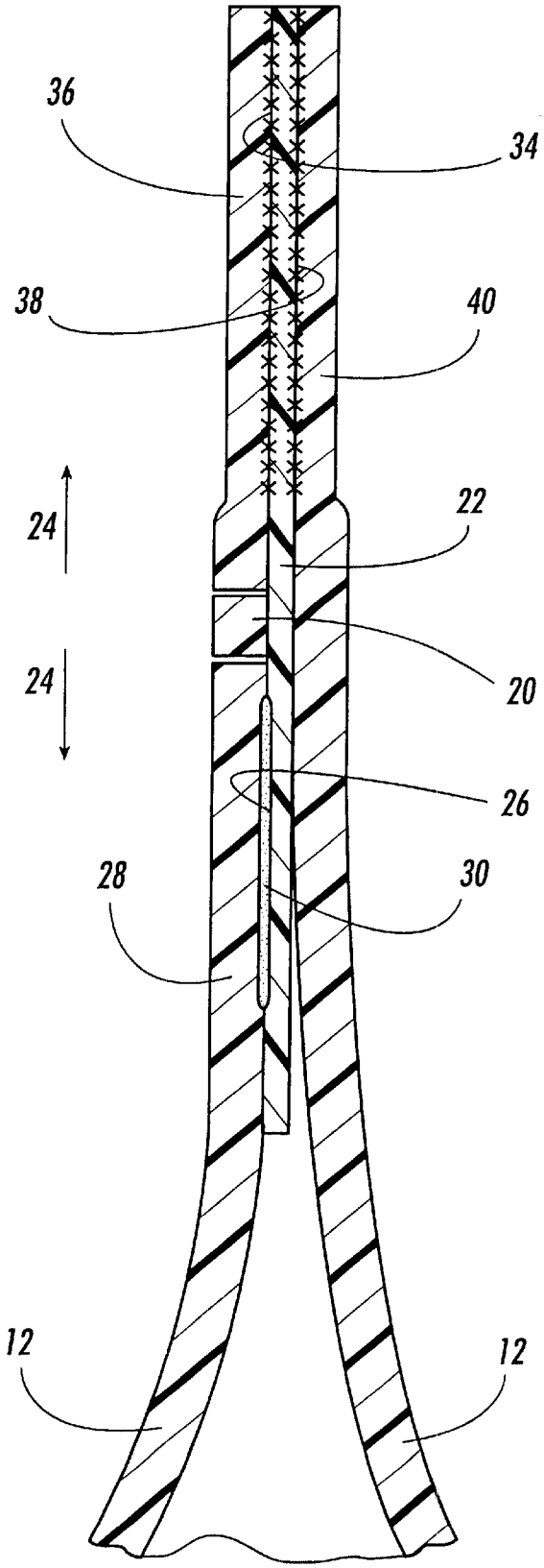
FIG. 2 is a cross-sectional view taken along the line 2—2 of the bag of FIG. 1.

A strip 22 of material is disposed in the interior of the bag 10 in covering relation to the opening location. As shown in FIG. 2, the strip 22 of material extends on opposite lateral sides 24 of the opening location and includes a lower front surface 26 that is releasably adhered to a lower front portion 28 of the bag 10 by a pressure sensitive adhesive 30 disposed on the strip 22 to one of the lateral sides 24 of the opening location. The strip 22 of material also includes a sufficient length to extend beyond opposite ends 32 of the transversely extending opening location for complete coverage of the opening location. To secure the strip 22 in place within the interior of the bag 10, an upper front surface 34 of the strip 22 also is permanently heat sealed to an upper front portion 36 of the bag 10, and an upper rear surface 38 of the strip 22 is permanently heat sealed to an upper rear portion 40 of the bag 10. While not shown in he drawings, a lower rear surface of the strip 22 also may be permanently heat sealed o the rear portion of the bag 10 in addition to, or as an alternative to, the permanent heat sealing of the upper rear surface 38 of the strip 22 to the upper rear portion 40 of the bag 10.

Figure 3:
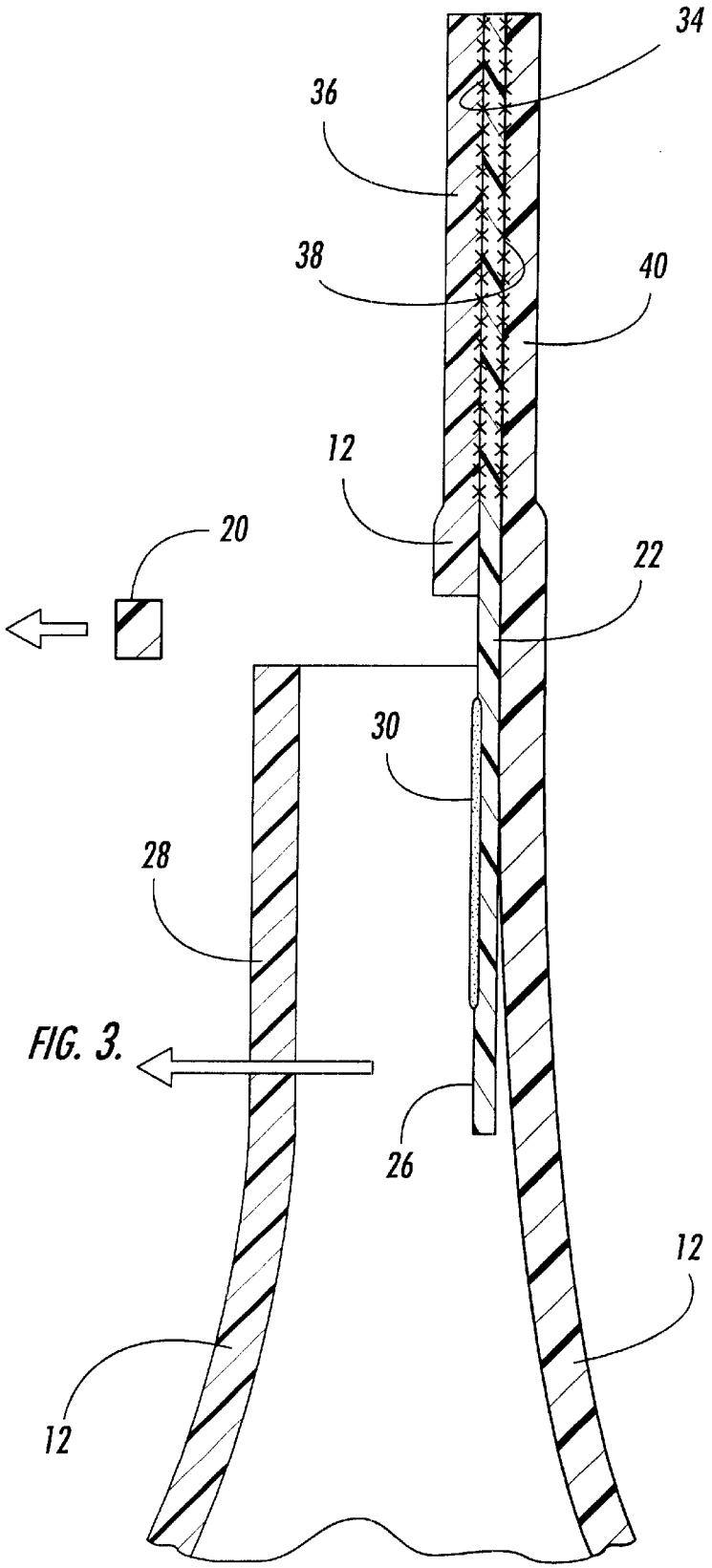
FIG. 3 is a cross-sectional view of the bag of FIG. 2 when opened.

Consequently, as shown in FIG. 3, when the panel 20 is removed, the lower front surface 26 of the strip 22 adhered by the pressure-sensitive adhesive 30 is separated from the lower front portion 28 of the bag 10 below the opening location, thereby opening the interior of the bag 10 and exposing the product retained therein to removal through the opening location. Furthermore, the permanent heat sealing of the strip 22 to the upper front and rear portions 36,40 of the bag 10 serve to retain the strip 22 within the bag 10 in a ready disposition for resealing thereof to the lower front portion 28 of the bag 10 in covering relation to the opening location. The pressure-sensitive adhesive 30 thus permits the strip 22 to be resealed to the bag 10 in covering relation to the opening location for continued retention of the product within the bag 10.

Figure 4:
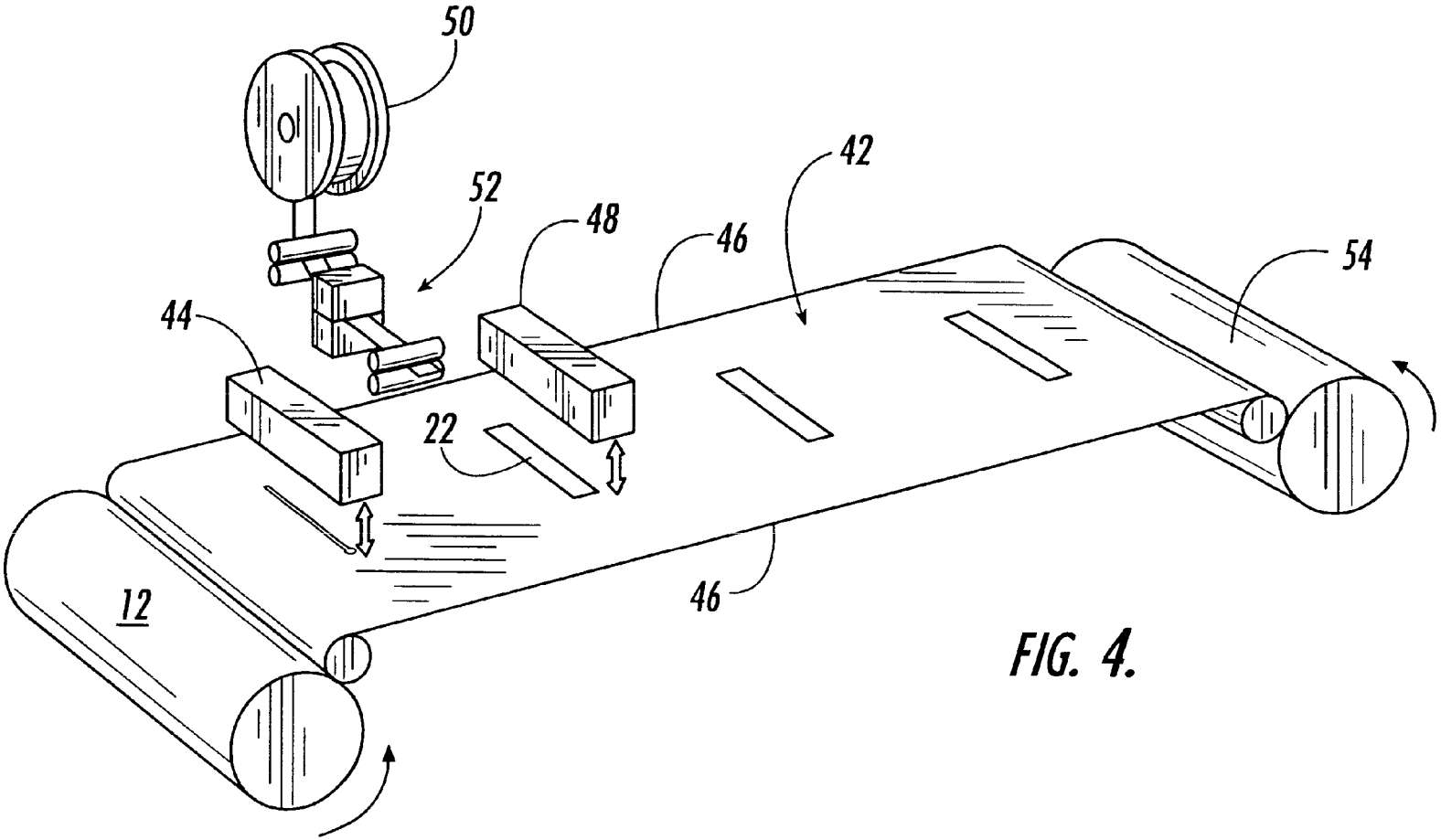
FIG. 4 is a schematic view of the method of the present invention of applying a strip of material to a web of bag material.
Figure 5:
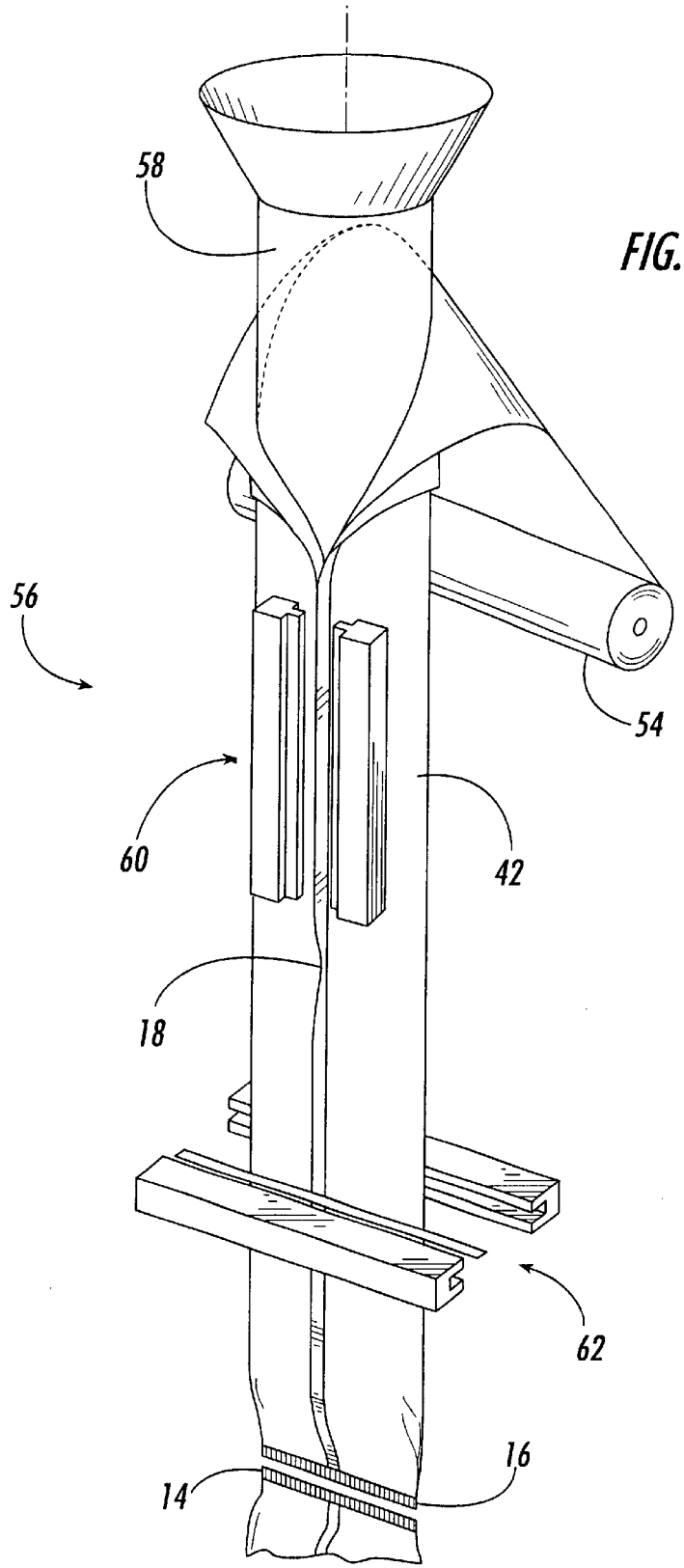
FIG. 5 is a schematic view of the method of folding and sealing the web of bag material to form the bag of the present invention.

The method of making the bag of FIGS. 1–3 is schematically shown in FIGS. 4–5. In particular, the transversely extending opening location is formed in a web 42 of the bag material 12 in an in-line process using conventional methods. First, a device 44 for perforating the web 42 creates a weakened line of perforations extending generally linearly between opposed side edges 46 of the web 42, the weakened line of perforations defining the panel 20. Next, the strip 22 of material having one side coated with the pressure sensitive adhesive 30 is advance and placed over the web 42 in covering relation to the panel 20 using a conventional device 48, the strip 22 being advanced from a stock roll 50 and cut to a predetermined length with a conventional device 52. The web 42 having the panel 20 formed therein and strip 22 of adhesive material placed thereover is then taken up to form a stock roll 54 of the bag material 12 that is ready for use on a VFF machine. Alternatively, the web 42 could be directly advanced to a VFF machine without being taken up on the roll 54. Furthermore, in a preferred modification of the method (not shown), a pressure sensitive adhesive is first applied to the web of the bag material and then a strip of material is then disposed over the adhesive for fixing to the web.

In FIG. 5 the finished web 42 of FIG. 4 is schematically shown being fed to a VFF machine 56 from the stock roll 54. The VFF machine 56 includes a conventional cylindrical feed tube 58 about which the web 42 is advanced into a tubular shape. The machine 56 also includes a conventional sealing apparatus 60 for forming the longitudinal side seal 18 in the web 42. Following formation of the longitudinal side seal 18, a transverse bottom end seal 16 is formed by an additional sealing apparatus 62 and then product is advanced into the open-ended tube-shaped web 42 through the cylindrical feed tube 58. The open-ended tube-shaped web 42 is then advanced past the additional sealing apparatus 62 and, when the next transverse bottom end seal 16 is formed in the tube-shaped web 42 by the additional sealing apparatus 62, the additional sealing apparatus 62 further forms a transverse top end seal 14 to render a finished bag 10. In this regard, the additional sealing apparatus 62 further includes a conventional cutting mechanism which simultaneously severs the instantly formed package from the tube-shaped web 42.

The additional sealing apparatus 62 forms the transverse end seals 14,16 by applying pressure and heat to the bag material 12. Furthermore, during the formation of the transverse end seals 14,16 by the additional sealing apparatus 62, the web 42 is advanced so that the strip 22 of material covering the opening location partially overlaps with the bag material 12 subjected to the pressure and heat of the additional sealing apparatus 62. The strip 22 of material also is selected to have similar heat seal characteristics to those of the bag material 12, whereby the strip 22 of material joins with the bag material 12 in the heat sealing process. The strip 22 of material is also disposed to extend through at least one-half of the width of the top end seal 14 formed by the additional sealing apparatus 62 in the bag material 12. This serves to securely retain the strip 22 of material within the bag 10 in proximity to the opening location for ready covering and resealing of the opening location.

Figure 6:
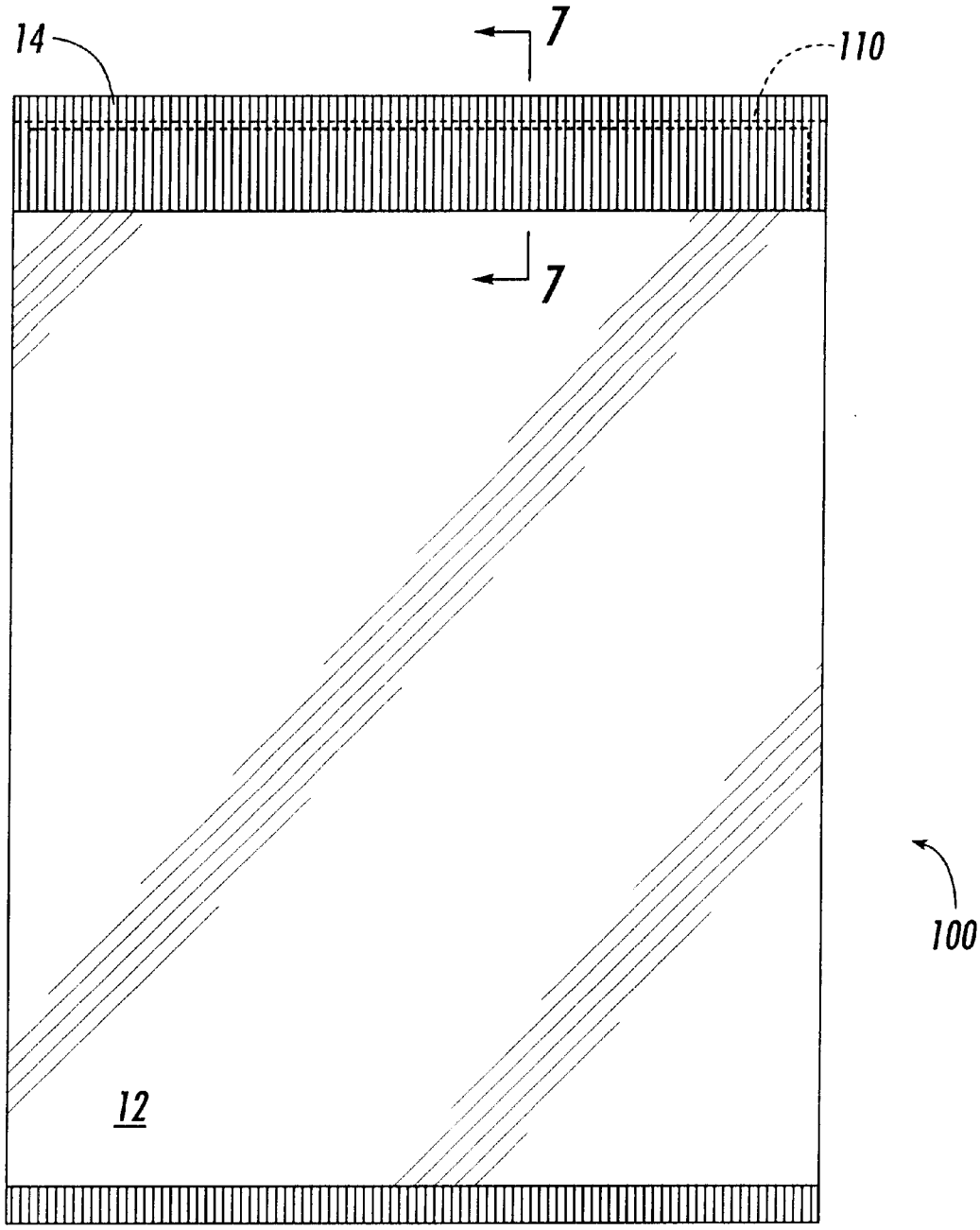
FIG. 6 is an elevational view of the front of another bag of the present invention.
Figure 7:
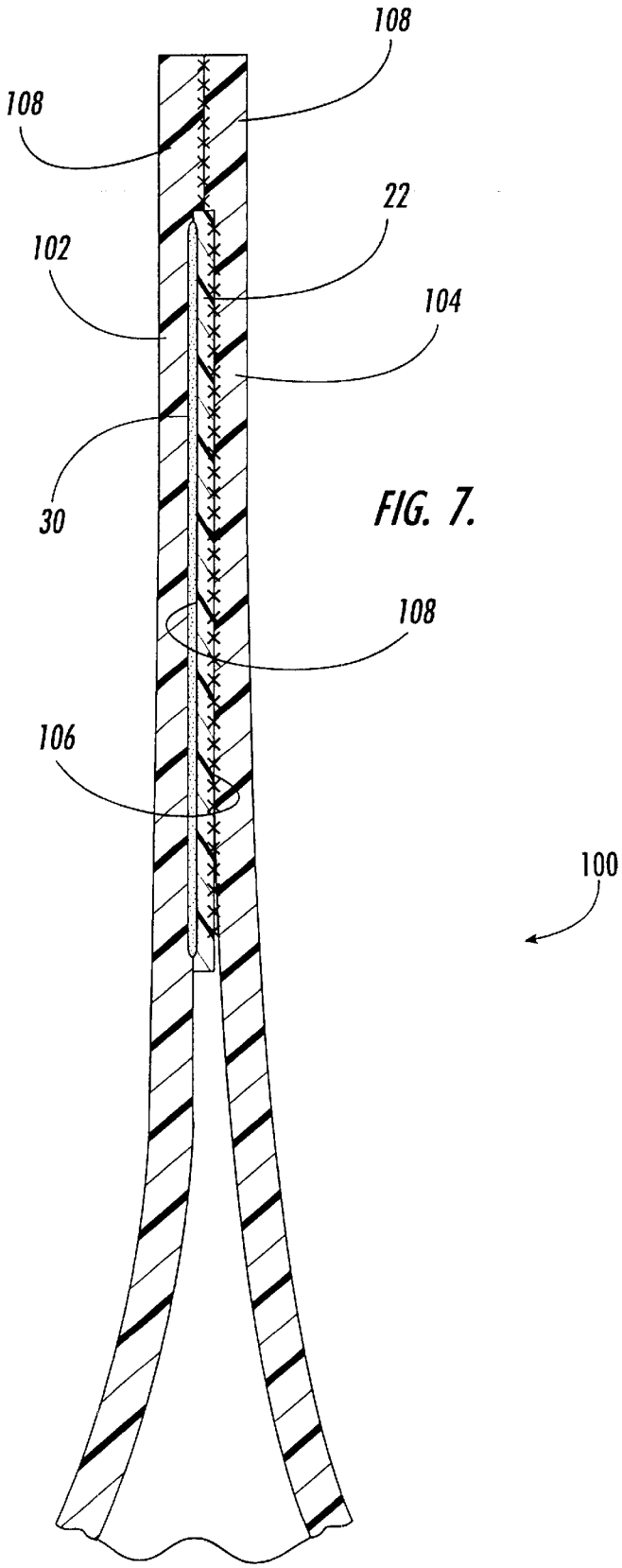
FIG. 7 is a cross-sectional view taken along the line 7—7 of the bag of FIG. 6.
Figure 8:
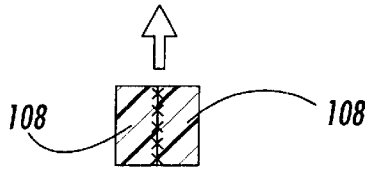
FIG. 8 is a cross-sectional view of the bag of FIG. 7 when opened.
Figure 8:
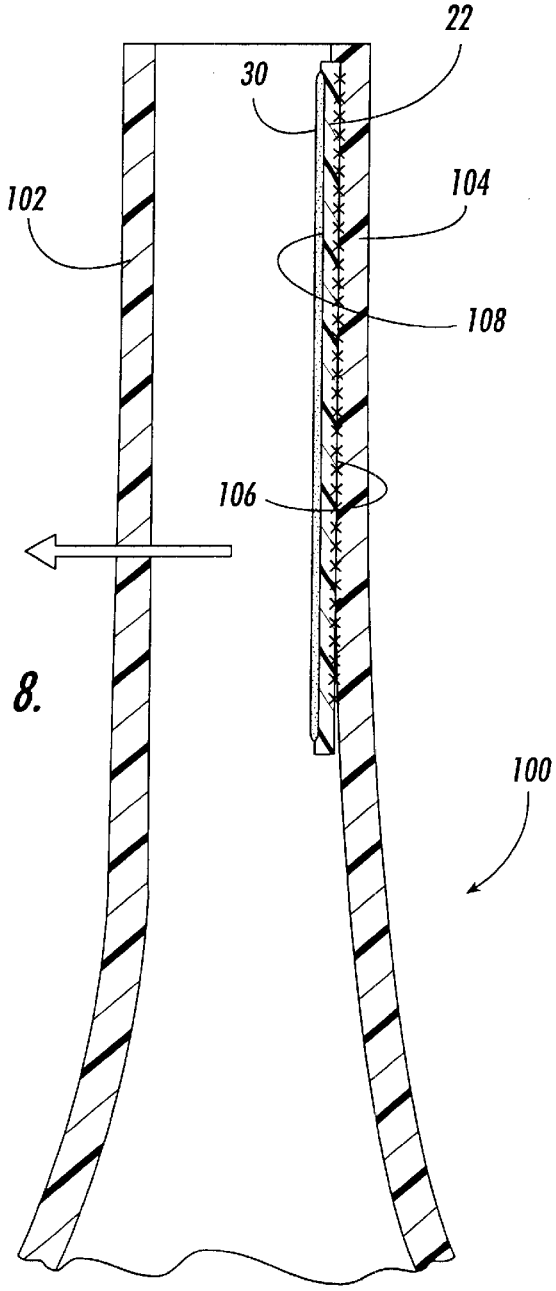

Another bag 100 of the present invention is shown in FIG. 6 and is substantially similar to the bag 10 of FIG. 1, the difference being that no opening location is formed in the bag material 12 of bag 100. Instead, the bag 100 is designed for opening at the transverse top end seal 14 thereof as illustrated in FIGS. 7 and 8.

To accommodate this type of opening, the strip 22 of material is releasably fixed to a front portion 102 with the pressure sensitive adhesive 30 and is permanently fixed to the bag 100 at a rear portion 104 by heat sealing. Consequently, when the front and rear portions 102,104 of the bag 100 are separated to open the end of the bag 100, the pressure sensitive adhesive 30 releases from the front portion 102 and, thereafter, the strip 22 of material later is re-adhered again to the front portion 102 of the bag 100 by the simple reapplication of pressure.

The method of forming the second bag 100 of the present invention is also substantially similar to the method illustrated in FIGS. 4 and 5, the differences being that: in fixing the strip 22 of material to the web 42 of bag material 12, no opening location is formed in the bag material 12; and in sealing the bag material 12 to form the transverse top end seal 14, only the bag material 12 overlapping the strip 22 of material and forming the rear portion 104 of the bag 100 is heated under pressure for heat sealing thereof to a rear surface 106 of the of the strip 22. The bag material 12 overlapping the strip 22 and forming the front portion 102 of the bag 100 is not heat sealed to the strip 22; rather, the bag material 12 overlapping the strip 22 and forming the front portion 102 of the bag 100 is simply adhered to a front surface 108 of the strip 22 via the pressure-sensitive adhesive 30.

In the preferred embodiment shown, the bag 100 is manufactured to make the transverse top end seal 14 hermetic. In this regard, top portions 108 of the upper front and rear portions 102,104 of the bag 100 which do not overlap the strip 22 are completely heat sealed together to form a non-reclosable transverse end seal. Moreover, the heat sealing of the top portions 108 is preferably continuous with the sealing of the upper front and rear portions 102,104 to the strip 22 of material.

Since the top portions 108 are heat sealed together to form a hermetic seal, the top portions of the upper front and rear portion 102,104 of the bag 100 must be removed before the bag is opened by pulling apart the upper front and rear portions 102,104 adhered together with the releasable adhesive 30. To facilitate removal, a tear-line 110 of perforations are formed in top portions 108. On the other hand, if the seal need not be hermetic (and thus may be easy to open), then a minimal shear force resulting from the pulling the front and rear portions of the bag apart (like the opening of a potato chip bag) will be sufficient to open the transverse end seal of the bag 100, and accordingly, the tear-line 110 may be omitted.

It will therefore be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor to be construed to limit the present invention or otherwise to exclude any such other embodiments, adaptations, variations, modifications and equivalent arrangements, the present invention being limited only by the claims appended hereto and the equivalents thereof.

What is claimed is:

1. A reclosable bag formed on a form, fill and seal machine, comprising:

a web of bag material folded and sealed together at a side seal and two end seals to define the bag; and a strip of material having a rear surface to which said bag material is sealed and a front surface disposed in covering relation to and on opposite lateral sides of a transversely extending opening feature formed in said bag material, said front surface of said strip of material being releasably attached to the bag material on only one lateral side of said opening feature by way of a pressure-sensitive adhesive.

2. The reclosable bag of claim 1, wherein said front surface of said strip of material is permanently sealed to said bag material on the other lateral side of said opening feature.

3. The reclosable bag of claim 1, wherein one of said end seals and said seal between said bag material and said rear surface of said strip of material are continuous with one another.

4. The reclosable bag of claim 1, wherein said strip of material extends less than a width of said web between opposite longitudinal edges thereof.

5. The reclosable bag of claim 4, wherein said strip extends slightly beyond opposed ends of said transversely extending opening feature.

* * * * *